US010617929B2

(12) United States Patent
Gomes

(10) Patent No.: US 10,617,929 B2
(45) Date of Patent: Apr. 14, 2020

(54) WIRELESS SYSTEM FOR USE WITH FENCING SCORING MACHINE

(71) Applicant: John F. Gomes, Carlsbad, CA (US)

(72) Inventor: John F. Gomes, Carlsbad, CA (US)

( * ) Notice: Subject to any disclaimer, the term of this patent is extended or adjusted under 35 U.S.C. 154(b) by 163 days.

(21) Appl. No.: 16/006,537

(22) Filed: Jun. 12, 2018

(65) Prior Publication Data

US 2018/0353825 A1 Dec. 13, 2018

Related U.S. Application Data

(60) Provisional application No. 62/518,587, filed on Jun. 12, 2017.

(51) Int. Cl.
*A63B 69/02* (2006.01)
*A63B 1/00* (2006.01)

(52) U.S. Cl.
CPC ..... *A63B 69/02* (2013.01); *A63B 1/00* (2013.01); *A63B 2220/80* (2013.01); *A63B 2225/50* (2013.01)

(58) Field of Classification Search
None
See application file for complete search history.

(56) References Cited

U.S. PATENT DOCUMENTS

| | | | | |
|---|---|---|---|---|
| 6,575,837 | B1 * | 6/2003 | Weske | A63B 69/02 463/47.1 |
| 6,743,151 | B2 * | 6/2004 | Riggs | A63B 69/02 446/473 |
| 2006/0100022 | A1 * | 5/2006 | Linsay | A63B 69/02 463/47.1 |
| 2008/0084281 | A1 * | 4/2008 | Huang | A63B 71/0605 340/323 R |
| 2013/0281217 | A1 * | 10/2013 | Florea | A63B 69/02 463/47.1 |
| 2015/0148114 | A1 * | 5/2015 | Morehouse | A63B 71/0605 463/8 |
| 2016/0158623 | A1 * | 6/2016 | Morehouse | A63B 69/02 273/148 R |
| 2017/0368443 | A1 * | 12/2017 | Foxworth | A63B 71/0669 |

* cited by examiner

*Primary Examiner* — Robert T Clarke, Jr.
(74) *Attorney, Agent, or Firm* — Coastal Patent Law Group, P.C.; Joshua S. Schoonover, Esq.

(57) ABSTRACT

A wireless system is disclosed for implementing with traditional fencing equipment and a conventional fencing scoring apparatus for eliminating reel cords in a fencing match. The wireless system utilizes a constant voltage applied to each opponent's sword, and a square wave voltage applied to the lame and other equipment of an opponent, such that voltage changes are utilized to detect contact events. The contact events are recorded in each opponent's transmitter (worn by the opponent) and converted to data for transmitting to a common receiver of the wireless system. The wireless system replaces the reel cord that traditionally connects the body cord of each fencing opponent to a scoring apparatus.

10 Claims, 3 Drawing Sheets

WIRELESS SYSTEM FOR USE WITH FENCING SCORING MACHINE

CROSS-REFERENCE TO RELATED APPLICATIONS

This application claims benefit of priority with U.S. Provisional Ser. No. 62/518,587, filed Jun. 12, 2017, titled "WIRELESS TRANSMITTER FOR FENCING SCORING MACHINE"; the entire contents of which are hereby incorporated by reference.

BACKGROUND

Fencing is a group of three related combat sports. The three disciplines in modern fencing are the foil, the épée, and the sabre; winning points are made through the contact with an opponent.

In Olympic fencing, points are scored by touching or hitting opponents (the "contact") with the tip or blade of an athlete's sword, which is wired to a buzzer that sounds to indicate contact, on a valid target area; in the foil, this is the trunk of the body, in the sabre everything above the waist, excluding hands, and in epee the entire body is legal. Colored lights on a conventional electrical scoring apparatus register valid hits, while white lights register hits landing outside the valid target area.

To measure contact, a conventional fencing scoring system includes at least: a sword, a lame (jacket), a body cord, a reel cord, and a scoring apparatus. The body cord is connected to each of a sword and lame of an opponent, and further connected to the reel cord. The reel cord is connected to the scoring apparatus. Each opponent of a fencing match is connected, and the scoring apparatus is generally configured to make a sound, light, or combination thereof upon a sword of a first opponent making contact with a lame or other equipment (guard, helmet, etc.) of a second opponent, and vice versa.

Problems with conventional fencing scoring systems include added bulk and other limitations of the reel cord. For example, the reel cords are difficult to travel with.

Closed loop electronic scoring systems are currently used to detect touches between fencers that can occur in a fraction of a second. It is composed of a scoring apparatus and wires (cords or cables) that connects the apparatus to the body cords of the fencer. These machines are programmed according to the latest fencing regulation do determine when a touch is valid, and also display the scoring of the match.

One of the major issues in fencing, for the fencers, clubs and event organizers, are the wires or cables used to connect the scoring apparatus and the body cord of the fencer. In order to avoid being in the way of the fencer, reels are used on the reel cord to keep them in constant tension so it can retract when the fencers walk backwards. This cause some pressure on the fencer, which he needs to overcome when walking forward. For the club or event organizers, there is the logistic challenge is setup all the wires for each lane, so it is not in the way of the competitors and participants.

Recently, wireless scoring systems have emerged in fencing, in particular for athletes who travel with clubs and find convenience in wireless systems. However, these wireless scoring systems are limited and unreliable, since, they operate using capacitance sensors and cannot be properly calibrated, or remain calibrated with sufficient reliability, or for sufficient duration, throughout a tournament match or event. In fact, there remains a need for a wireless fencing scoring system that does not require a common ground or sensor calibration, and which is portable and suitable for tournament use with sufficient reliability and accuracy.

SUMMARY

The embodiments disclosed herein overcome these and other problems by providing a reliable wireless system for use with a conventional fencing scoring machine which can be used in tournament fencing.

The wireless system for use with a fencing scoring apparatus is described, wherein a square wave voltage is applied to certain equipment of each fencing opponent, and a constant voltage is applied to a sword of each opponent, such that voltage changes at the sword are detected by a transmitter worn by the respective opponents, and data relating the voltage changes, or contact events, is wirelessly transmitted to a common receiver.

The receiver and two transmitters (one transmitter for each opponent) are assigned to a fencing lane. Each lane can be assigned a unique frequency, wherein the square wave is adjusted to implement the selected frequency for a given lane, thereby isolating each lane according to the selected frequency. Each transmitter can detect small changes in voltages, or voltage spikes, caused when a sword (with constant voltage) makes contact with equipment (with square wave voltage). These voltage spikes are differentiated by the respective transmitter, and data is recorded. The data is sent to the receiver for scheduling contact events (touches) of a fencing match.

The receiver may buffer the data received from each transmitter by adding a time-delay, such as 100 ms or other time, and schedule in software associated with the receiver. After the 100 ms has lapsed, the receiver may communicate to the scoring apparatus, each contact event according to the buffered data in the order as according to the scheduler.

These and other features are further described in the appended detailed descriptions and drawings.

DETAILED DESCRIPTION

Figure 1:
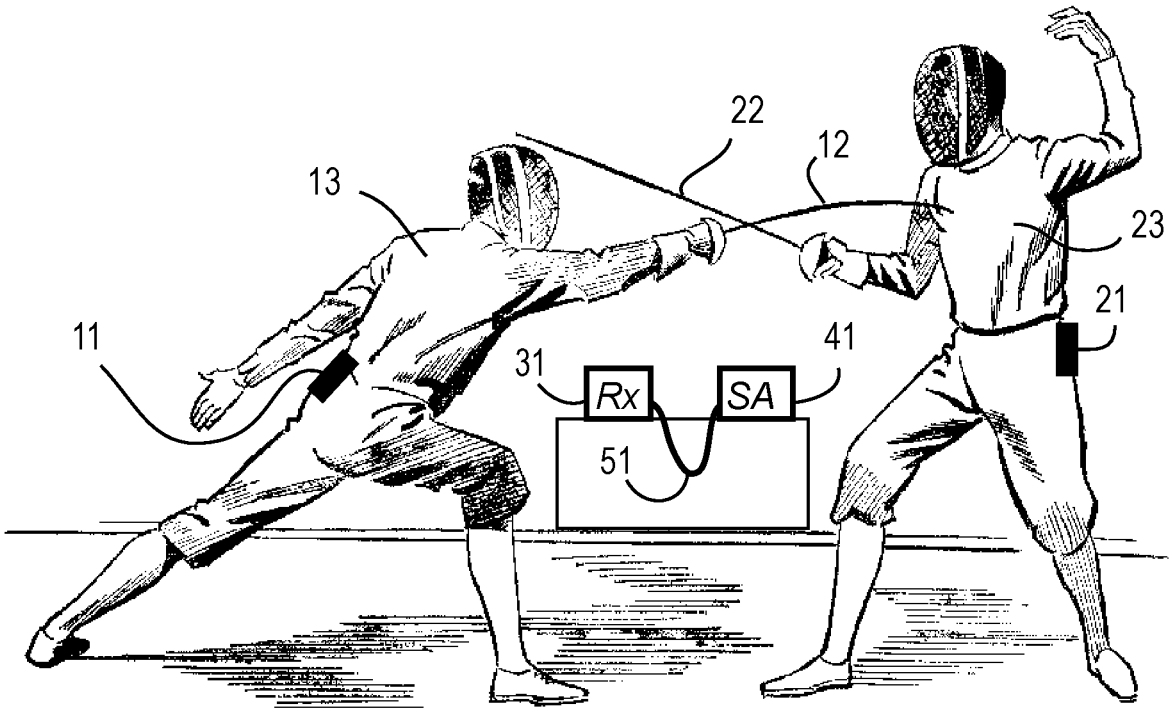
FIG. 1 depicts a fencing match wherein each of two opponents wears one of a first and second transmitter, the transmitter communicates data to a receiver, and the receiver is coupled to a conventional fencing scoring apparatus for reacting to the data.

In the following description, for purposes of explanation and not limitation, details and descriptions are set forth in order to provide a thorough understanding of the embodiments of the invention. However, it will be apparent to those skilled in the art that the present invention may be practiced in other embodiments, including certain variations or alternative combinations that depart from these details and descriptions. The scope of the invention is not intended to be limited to the illustrated examples herein; rather, any limitation or determination of scope of the invention is intended to be ascertained upon a review of the appended claims.

In a general embodiment, a wireless system for use with a conventional fencing scoring apparatus is disclosed. The wireless system includes a first transmitter, a second transmitter and a receiver. The system is configured to detect contact between fencing opponents during a match, wherein the detecting is achieved by measuring changes in voltage applied to equipment of the fencing opponents. In particular, a square wave voltage is applied to equipment of an opponent (lame, guard, mask, etc.) and a constant voltage is applied to a sword of each opponent. When the constant voltage of the sword makes a contact with equipment charged by a square wave voltage, subtle variations or changes in the sword's voltage can be detected, and events recorded in time according to a clock associated with the respective transceiver. These "contact events", or voltage spikes caused by the opponents making contact, are then recorded and transmitted as data to a receiver. The receiver is capable of receiving, ordering, and replaying the contact events, such that the conventional fencing scoring machine is utilized with signals communicated to it from the receiver.

No calibration (such as multiple touches to register capacitance) is required by the disclosed wireless system, except syncing clocks of the first transmitter, second transmitter and receiver prior to a fencing match which may be accomplished by holding the devices in close proximity (via conventional software techniques, such as near field communication). Optionally, the system can be configured to automatically select square wave frequency of the transmitters, a Wi-Fi channel for transmitting the data packets from the transmitters, and the clocks of all three devices in a lane.

Each transmitter can be held in a pocket, or by a mechanical attachment as would be appreciated by one having skill in the art.

In one embodiment, a wireless system for use with a fencing scoring apparatus, the wireless system comprising: a first transmitter, the first transmitter configured to couple with a first body cord, the first body cord further connected to at least a first sword and a first lame; a second transmitter, the second transmitter configured to couple with a second body cord, the second body cord further connected to at least a second sword and a second lame, and a receiver, each of the first transmitter, second transmitter and receiver individually comprising a clock, wherein each clock is adapted for syncing with one another and keeping time; characterized in that: the first transmitter is configured to: supply a first constant voltage to the first sword, supply a first square wave voltage to the first lame, measure deviations of the first constant voltage of the first sword to detect up to a plurality of first contact events, for each of the first contact events record a corresponding first timestamp based on the clock associated with the first transmitter and respective time at which the first contact event occurred, and transmit first data to the receiver, said first data including the first timestamps; the second transmitter is configured to: supply a second constant voltage to the second sword, supply a second square wave voltage to the second lame, measure deviations of the second constant voltage of the second sword to detect up to a plurality of second contact events, for each of the second contact events record a corresponding second timestamp based on the clock associated with the second transmitter and respective time at which the second contact event occurred, and transmit second data to the receiver, said second data including the second timestamps; further characterized in that the receiver is configured to: receive the first data from the first transmitter, receive the second data from the second transmitter, populate the first and second data into a common scheduler, order the first and second contact events within the common scheduler according to the first and second timestamps; and replay signals associated with the first and second contact events to the fencing scoring apparatus in sequence according to said order.

In some embodiments, at least one of the first and second square wave voltages ranges between 0.0 Volts and 5.0 Volts.

In some embodiments, the system further comprises a scoring system cord, the scoring system cord being configured to extend between the receiver and the fencing scoring apparatus.

In some embodiments, at least one of the first and second transmitter is adapted to detect a change in the first constant voltage of the first sword when: (i) the first sword makes contact with the first lame, (ii) the first sword loses contact with the first lame, (iii) the first sword makes contact with the second lame, (iv) the first sword loses contact with the second lame, (v) a first button associated with the first sword is closed, or (vi) a first button associated with the first sword is open.

In some embodiments, the first transmitter comprises a first operational amplifier, wherein the change in the first constant voltage is detected by the first operational amplifier.

In some embodiments, each of the first and second transmitters is individually configured for selecting a first frequency from a plurality of possible frequencies, the first frequency being implemented with each of the first square wave voltage and the second square wave voltage, respectively.

In some embodiments, the first frequency is one of 8.0 KHz, 16.0 KHz, 24.0 KHz, 32.0 KHz, or 40.0 KHz.

In some embodiments, the receiver is further configured to buffer the first and second data to form buffered data, wherein the receiver adds a time-delay to each of the first and second timestamps of the first and second data to form the buffered data.

In some embodiments, the time-delay comprises 100 ms. This time-delay compensates for time of travel of the wireless signals between the respective transmitters and the receiver. For example, the transmitters detect voltage changes, and using software, determine a "contact event" (distinguishing from a plurality of possible events (in the data we refer to contact events as "touch type codes"), such as opponent 1, sword 1, touches opponent 2, lame 2; inter alia). Each contact event (or touch type code in data) is related to time, according to the transmitter clock, and the clocks of all system components are synced prior to the match. In addition, transmitter ID (and thereby opponent ID) is recorded in the data. Therefore, the data packets can comprise a number of events, in the form of (transmitter ID, touch type code, time). This data can be populated in a lookup table, or in code, and is transmitted to the receiver.

The receiver may receive a data packet in the form of (transmitter ID, touch type code, time), or any similar format, and add a time delay to the time to determine buffered-time. For example, we disclose a preferred time-delay of 100 ms, which is intended to compensate for transmission delay. In this regard, the data can be converted to the format (transmitter ID, touch type code, buffered time). Whether buffered or not, the receiver then populates a lookup table or code with each contact event according to the data (or buffered data), referred to herein as a "scheduler". The scheduler is a re-creation of the events received from the data. For example, data from first transmitter is combined with data from second transmitter in the scheduler. Now, the scheduler can re-play the contact events according to the match in the order of time (or buffered time). The re-play can be used to send signals to the conventional fencing scoring machine.

Now turning to the drawings, FIG. 1 depicts a fencing match wherein each of two opponents wears one of a first transmitter 11 and second transmitter 21, each transmitter communicates data to a receiver (Rx) 31, and the receiver is coupled to a conventional fencing scoring apparatus (SA) 41 for reacting to the data.

The first opponent wearing the first transmitter 11 is also shown holding first sword 12 and wearing a first lame 13. The second opponent wearing the second transmitter 21 is also shown holding second sword 22 and wearing second lame 23.

First transmitter 11 is connected to first sword 12 and first lame 13 via a first body cord (not shown, worn under equipment). The first body cord supplies a first square wave voltage, provided from first transmitter 11, to at least first lame 13, and optionally a guard, mask or helmet, and other equipment depending on the type of fencing practiced (foil, epee, or sabre). The first square wave voltage includes a first amplitude (for example, 0V to +5V), and a first frequency. In addition, the first transmitter 11 further supplies a first constant voltage to the first sword 12.

Similarly, second transmitter 21 is connected to second sword 22 and second lame 23 via a second body cord (not shown, worn under equipment). The second body cord supplies a second square wave voltage, provided from second transmitter 21, to at least second lame 23, and optionally a guard, mask or helmet, and other equipment depending on the type of fencing practiced (foil, epee, or sabre). The second square wave voltage includes a second amplitude (for example, 0V to +5V), and a second frequency. In addition, the second transmitter 21 further supplies a second constant voltage to the second sword 12.

It is currently preferred that the amplitudes and frequencies of the first and second square wave voltages, respectively, are the same with respect to each opponent (but not necessarily the same with opponents of adjacent lanes); and that the first and second constant voltages are also the same with respect to opponents in a shared lane.

It is preferred that the first and second amplitudes range between 0V and +5V; however, any square wave voltage may be similarly implemented.

It is further preferred that the first and second frequencies are the same and selected from one of a plurality of selectable frequencies via switch and respective circuits of each transmitter, wherein the one of the plurality of selectable frequencies comprises one of: 8.0 KHz, 16.0 KHz, 24.0 KHz, 32.0 KHz, or 40.0 KHz. Again, while certain voltages and frequencies are expressly provided, one with skill in the art will recognize that other voltages and/or frequencies may be similarly implemented with the expectation of similar results.

In addition, while it is presently preferred that first and second frequencies, and first and second amplitudes be the same for each opponent in a common lane, it is possible to program software for adjustments where the first and second amplitudes and/or first and second frequencies differ between opponents of a shared lane.

While other benefits may be realized, it is presently contemplated to provide transmitters with multiple selectable frequencies for applying to the square wave voltage of each transceiver such that multiple lanes (for corresponding matches) may be concurrently practiced at distinct frequencies and such that a given receiver is not confused by cross-talk, for example if multiple lanes all used the same frequency. In this regard, by selecting a common voltage and/or frequency for opponents of a given lane and distinguishing the voltage and/or frequency for opponents of different lanes, one or more receivers can be programmed or selected to differentiate between contact events of different lanes or matches.

Whereas in a conventional fencing scoring system a reel cord is connected to each opponent's body cord, and further connected to the conventional fencing scoring apparatus, the embodiments herein replace the reel cord with a wireless system formed by two transmitters and a receiver.

The body cords can be any body cord, such as a conventional body cord, as would be known by one with skill in the art. Similarly, the sword, lame, helmet or mask, and other equipment may be conventional fencing equipment.

Figure 2:
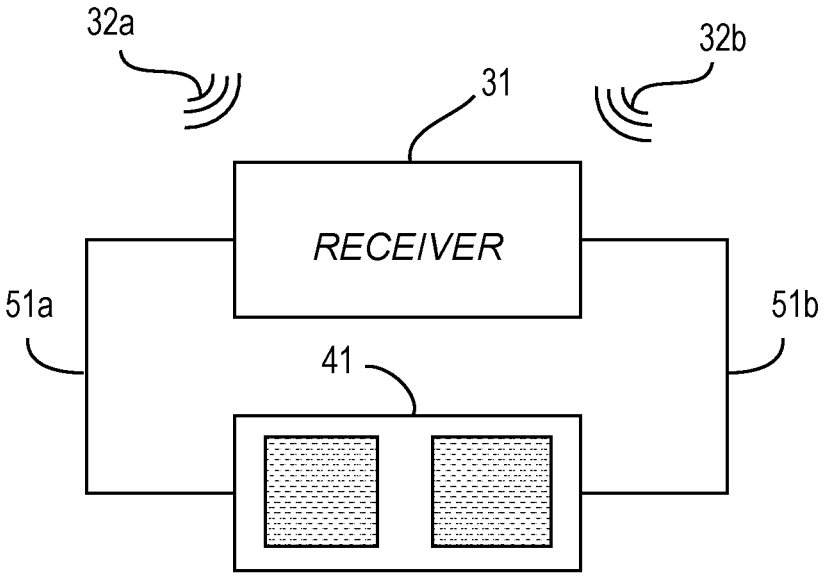
FIG. 2 is a schematic representation of the receiver and fencing scoring apparatus of FIG. 1.

FIG. 2 is a schematic representation of the receiver and fencing scoring apparatus of FIG. 1. The fencing scoring apparatus 41 is intended to be any conventional fencing scoring apparatus known to one having skill in the art. The receiver, however, forms a novel component that is inserted in place of the reel cord as mentioned above. The receiver 31 is configured to receive wireless data packets 32*a*; 32*b* and process the wireless data packets to build in software or lookup table a "scheduler", wherein the scheduler is a time ordered series of events ("contact events") wherein each opponent makes a contact with himself or the other opponent. The scheduler then re-builds the contact events in order of which they occurred and creates signals for sending through one or more scoring system cords 51*a*; 51*b* to the conventional fencing scoring apparatus 41.

Figure 3:
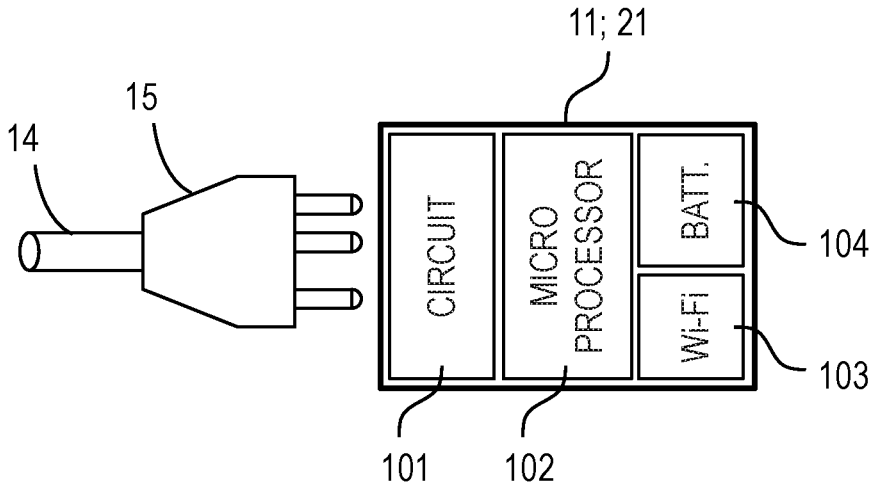
FIG. 3 is a schematic of a transmitter according to an embodiment.

FIG. 3 is a schematic of a transmitter according to an embodiment. The transmitter 11; 21 generally includes a battery 104; a radio transmitter circuit, preferably a Wi-Fi transmitter circuit 103; a micro processor 102; and one or more electronic circuits 101 for supplying and detecting voltages. Each transmitter further comprises a housing for containing these and other components.

Also shown is a portion of body cord 14, which includes body cord connector 15 for plugging into the transmitter.

The one or more electronic circuits supplies each of: (i) the square wave voltage to the lame and optional additional equipment, and (ii) the constant voltage to the sword; and detects voltage (and/or voltage changes) at the sword when contact is made with an opponent or other object.

The micro processor 102 processes the voltage (or voltage changes) at the sword as received by the one or more electronic circuits 101; and communicates data packets using the Wi-Fi radio circuit 103 to the receiver (See FIG. 2).

Figure 4:
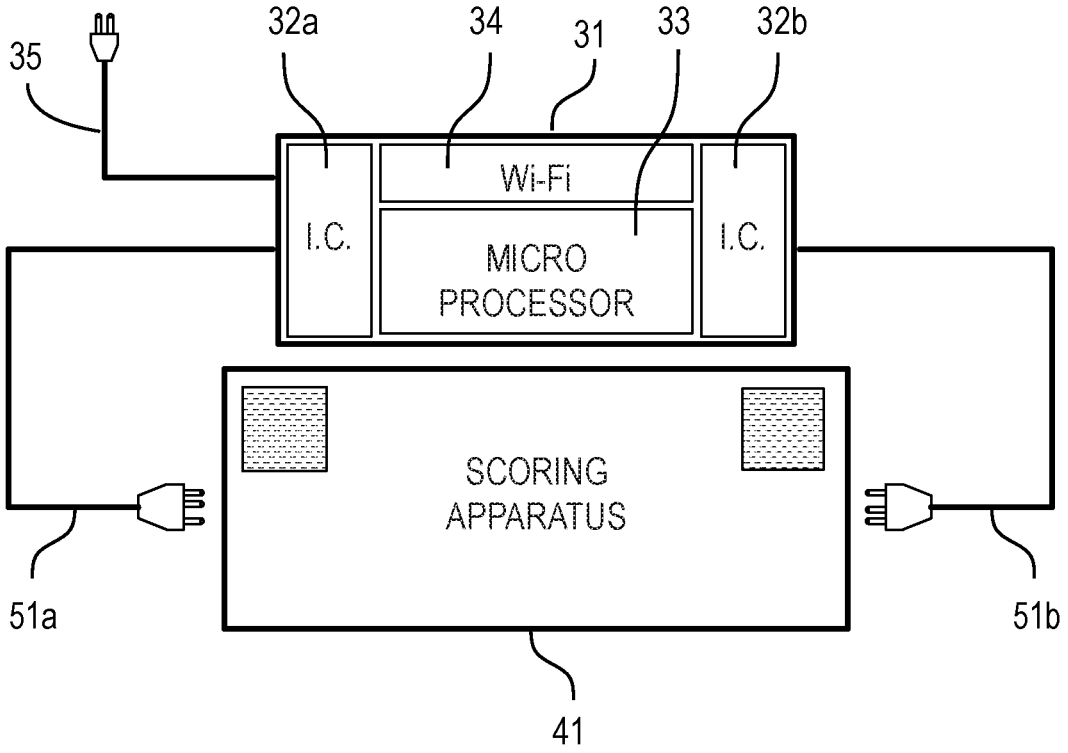
FIG. 4 is a schematic of a receiver and fencing scoring apparatus according to an embodiment.

FIG. 4 is a schematic of a receiver and fencing scoring apparatus according to an embodiment. The conventional fencing scoring apparatus includes two channels, one for each opponent of a fencing match. Traditionally, reel cords connect to the scoring machine and supply signals for interpretation by the conventional fencing scoring apparatus. Here, the two channels are replicated by the receiver using a pair of integrated circuits 32*a*; 32*b*, which receive information from a micro processor 33 after the micro processor decodes information received from a radio circuit, preferably a Wi-Fi radio circuit 34. The receiver is shown with power cord 35 for supplying power to the receiver unit. Scoring system cords 51*a*; 51*b* are shown connecting the receiver 31 to the fencing scoring apparatus 41.

While two scoring system cords are shown, it is contemplated that a single scoring system cord may be similarly implemented if the scoring apparatus is adapted to receive a single scoring system cord. However, since a conventional scoring apparatus requires two cords, one for each opponent, it is preferred to provide a receiver capable of delivering two channels (and two cords) for use with a conventional fencing scoring apparatus.

Figure 5:
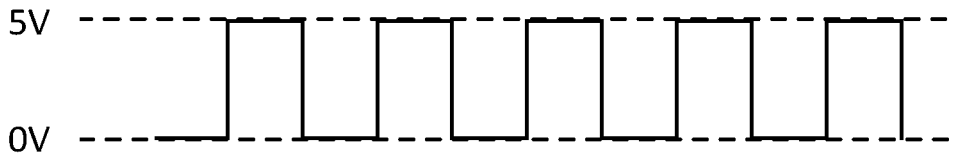
FIG. 5 shows a square wave voltage as-applied to equipment of a fencing opponent in accordance with an embodiment.

FIG. 5 shows a square wave voltage as-applied to equipment of a fencing opponent in accordance with an embodiment. As indicated above, the square wave voltage is applied to at least a lame of a respective opponent, but depending on the style of fencing, may be applied to other components of fencing equipment. Here, the square wave is shown having an amplitude of +5 Volts.

Figure 6:
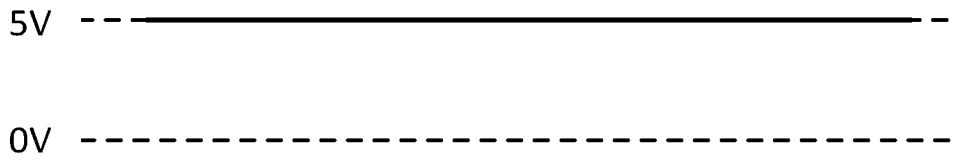
FIG. 6 shows a constant voltage as-applied to a sword of a fencing opponent in accordance with an embodiment.

FIG. 6 shows a constant voltage as-applied to a sword of a fencing opponent in accordance with an embodiment. Here, the constant voltage at the opponent's sword is supplied at +5 Volts. This figure is indicative of a sword when no contact is being made (the signal is flat).

Figure 7:
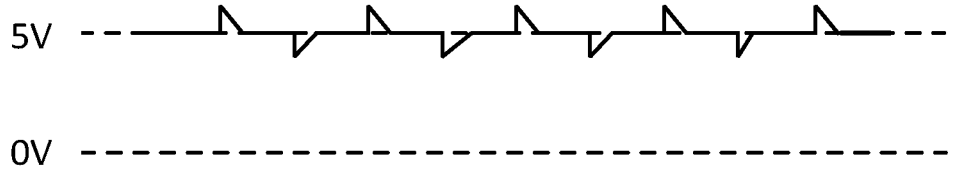
FIG. 7 shows voltage changes (voltage spikes) which may be detected at the sword of a fencing opponent when the sword makes contact with equipment charged with a square wave voltage.

FIG. 7 shows voltage changes (voltage spikes) which may be detected at the sword of a fencing opponent when the sword makes contact with equipment charged with a square wave voltage. Here, the signal shows variations in the flat voltage of FIG. 6, which is indicative of a contact between the sword and something else. Subtle voltage spikes can be analyzed to determine if the opponent made contact with himself, if the opponent made contact with the other opponent, or if the opponent contacted some other surface. A simple operational amplifier can be implemented in the transmitter to determine the frequency of the contacted surface.

REFERENCE SIGNS first transmitter (11)
first sword (12)
first lame (13)
body cord (14)
body cord connector (15)
second transmitter (21)
second sword (22)
second lame (23)
receiver (31)
wireless data packets (32*a*; 32*b*)
receiver microprocessor (33)
receiver radio circuit (34)
power cord (35)
scoring apparatus (41)
scoring system cords (51; 51*a*; 51*b*)
electronic circuits (101)
transmitter microprocessor (102)
transmitter radio circuit (103)
battery (104)

What is claimed is:

1. A wireless system for use with a fencing scoring apparatus, the wireless system comprising:

a first transmitter, the first transmitter configured to couple with a first body cord, the first body cord further connected to at least a first sword and a first lame;

a second transmitter, the second transmitter configured to couple with a second body cord, the second body cord further connected to at least a second sword and a second lame, and a receiver, each of the first transmitter, second transmitter and receiver individually comprising a clock, wherein each clock is adapted for syncing with one another and keeping time;

characterized in that:

the first transmitter is configured to:

supply a first constant voltage to the first sword, supply a first square wave voltage to at least the first lame, measure deviations of the first constant voltage of the first sword to detect up to a plurality of first contact events, for each of the first contact events record a corresponding first timestamp based on the clock associated with the first transmitter and respective time at which the first contact event occurred, and transmit first data to the receiver, said first data including at least the first timestamps;

the second transmitter is configured to:

supply a second constant voltage to the second sword, supply a second square wave voltage to at least the second lame, measure deviations of the second constant voltage of the second sword to detect up to a plurality of second contact events, for each of the second contact events record a corresponding second timestamp based on the clock associated with the second transmitter and respective time at which the second contact event occurred, and transmit second data to the receiver, said second data including at least the second timestamps; and further characterized in that the receiver is configured to:

receive the first data from the first transmitter, receive the second data from the second transmitter, populate the first and second data into a common scheduler, order the first and second contact events within the common scheduler according to the first and second timestamps; and replay signals associated with the first and second contact events to the fencing scoring apparatus in sequence according to said order.

2. The wireless system of claim 1, wherein at least one of the first and second square wave voltages ranges between 0.0 Volts and 5.0 Volts.

3. The wireless system of claim 1, further comprising a scoring system cord, the scoring system cord being configured to extend between the receiver and the fencing scoring apparatus.

4. The wireless system of claim 1, wherein the first transmitter is adapted to detect a change in the first constant voltage of the first sword when: (i) the first sword makes contact with the first lame, (ii) the first sword loses contact with the first lame, (iii) the first sword makes contact with the second lame, (iv) the first sword loses contact with the second lame, (v) a first button associated with the first sword is closed, or (vi) a first button associated with the first sword is open.

5. The wireless system of claim 4, wherein the first transmitter comprises a first operational amplifier, wherein the change in the first constant voltage is detected by the first operational amplifier.

6. The wireless system of claim 1, wherein each of the first and second transmitters is individually configured for selecting a first frequency from a plurality of possible frequencies, the first frequency being implemented with each of the first square wave voltage and the second square wave voltage, respectively.

7. The wireless system of claim 6, wherein the first frequency is one of 8.0 KHz, 16.0 KHz, 24.0 KHz, 32.0 KHz, or 40.0 KHz.

8. The wireless system of claim 1, wherein the receiver is further configured to buffer the first and second data to form buffered data, wherein the receiver adds a time-delay to each of the first and second timestamps of the first and second data to form the buffered data.

9. The wireless system of claim 8, wherein the time-delay comprises 100 ms.

10. A wireless system for use with a fencing scoring apparatus, the wireless system comprising:

a first transmitter, the first transmitter configured to couple with a first body cord, the first body cord further connected to at least a first sword and a first lame; and a receiver, each of the first transmitter and receiver individually comprising a clock, wherein each clock is adapted for syncing with one another and keeping time;

the first transmitter is configured to:

supply a first constant voltage to the first sword, supply a first square wave voltage to at least the first lame, measure deviations of the first constant voltage of the first sword to detect up to a plurality of first contact events, for each of the first contact events record a corresponding first timestamp based on the clock associated with the first transmitter and respective time at which the first contact event occurred, and transmit first data to the receiver, said first data including at least the first timestamps; and further characterized in that the receiver is configured to:

receive the first data from the first transmitter, populate the first data into a scheduler, order the first contact events within the scheduler according to the first timestamps; and replay signals associated with the first contact events to the fencing scoring apparatus in sequence according to said order.

* * * * *